US006457273B2

(12) United States Patent
Gussalli Beretta

(10) Patent No.: US 6,457,273 B2
(45) Date of Patent: Oct. 1, 2002

(54) DEVICE FOR SETTING THE STOCK ANGLE FOR SHOTGUNS

(75) Inventor: Ugo Gussalli Beretta, Brescia (IT)

(73) Assignee: Fabbrica d'Armi P. Beretta S.p.A. (IT)

( * ) Notice: Subject to any disclaimer, the term of this patent is extended or adjusted under 35 U.S.C. 154(b) by 0 days.

(21) Appl. No.: 09/739,522

(22) Filed: Dec. 18, 2000

(30) Foreign Application Priority Data

Feb. 17, 2000 (IT) ..... BO00A0010

(51) Int. Cl.[7] ..... F41C 23/00
(52) U.S. Cl. ..... 42/73
(58) Field of Search ..... 42/73

(56) References Cited

U.S. PATENT DOCUMENTS 2,432,519 A * 12/1947 Garand
3,710,496 A * 1/1973 Packmayr et al.
4,122,623 A * 10/1978 Stice
4,422,256 A * 12/1983 Maucher
4,589,219 A * 5/1986 Milliman
4,663,877 A * 5/1987 Bragg
4,896,446 A * 1/1990 Gregory
5,031,348 A * 7/1991 Carey
5,235,764 A * 8/1993 Perazzi
5,392,553 A * 2/1995 Carey
5,519,957 A * 5/1996 Iannetta
5,933,997 A * 8/1999 Barrett
5,970,642 A * 10/1999 Martin
6,032,397 A * 3/2000 Iannetta

FOREIGN PATENT DOCUMENTS

DE 0137376 * 1/1903

* cited by examiner

*Primary Examiner*—Charles T. Jordan
*Assistant Examiner*—Troy Chambers
(74) *Attorney, Agent, or Firm*—McGlew and Tuttle, P.C.

(57) ABSTRACT

The invention concerns a device for setting the angle of the stock for shotguns. It includes a fixed plate (11) for fixing to a part of the stock body, a mobile plate (12) for fixing to another part of the stock, a vertical guide element (13) anchored above the fixed plate (11) that can be positioned at least in one transverse direction and be associated to a memory element. The mobile part is connected to the guide element and can be moved in several directions and angularly on and with respect to the same for the positioning of one part of the stock on the other.

15 Claims, 5 Drawing Sheets

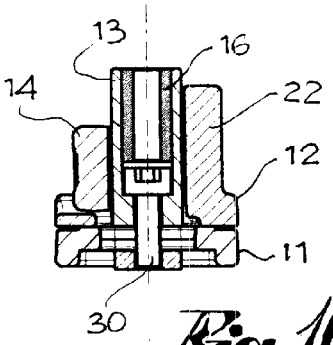
Fig. 10
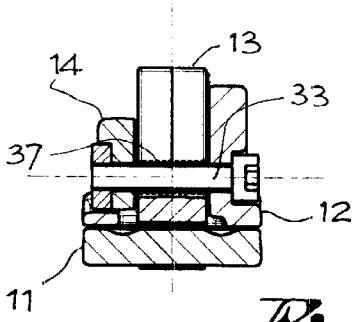
Fig. 11
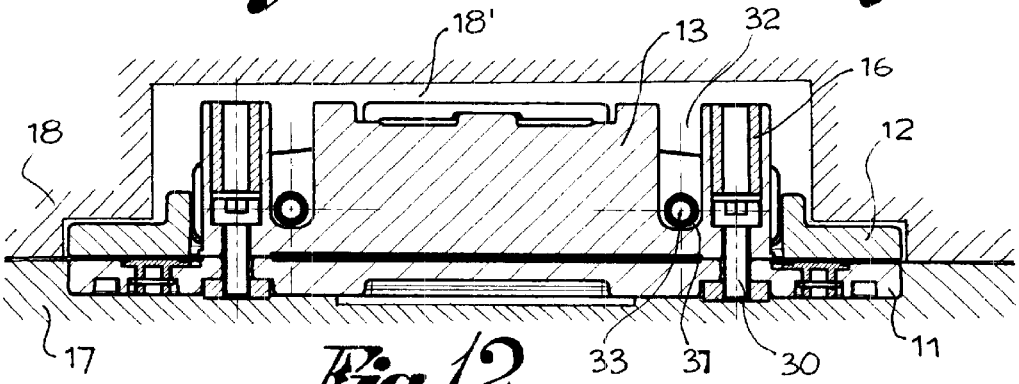
Fig. 12
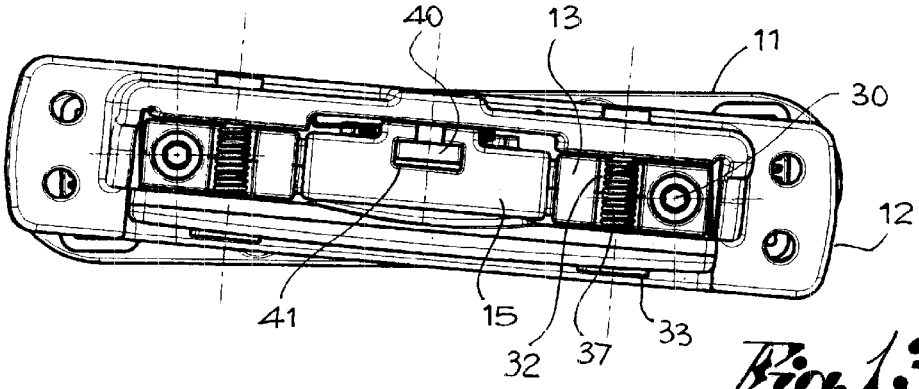
Fig. 13
Fig. 14
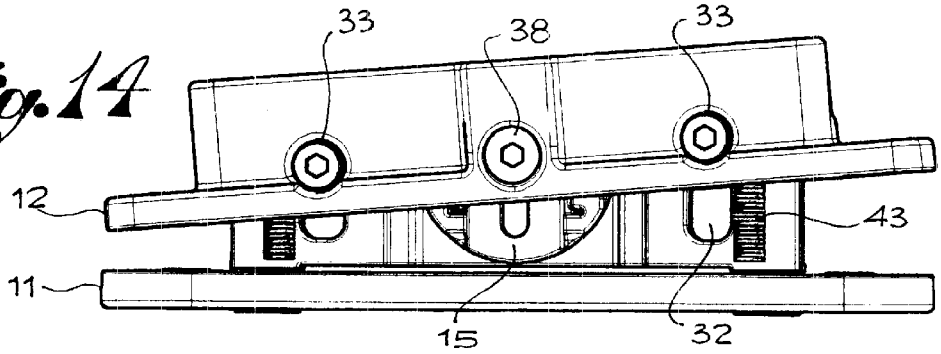

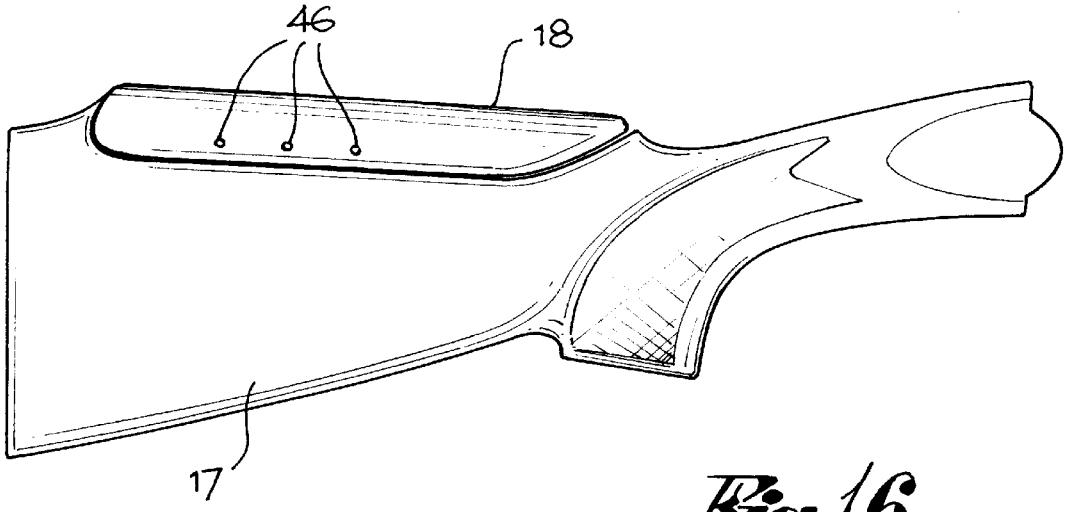
Fig.16
Fig.15
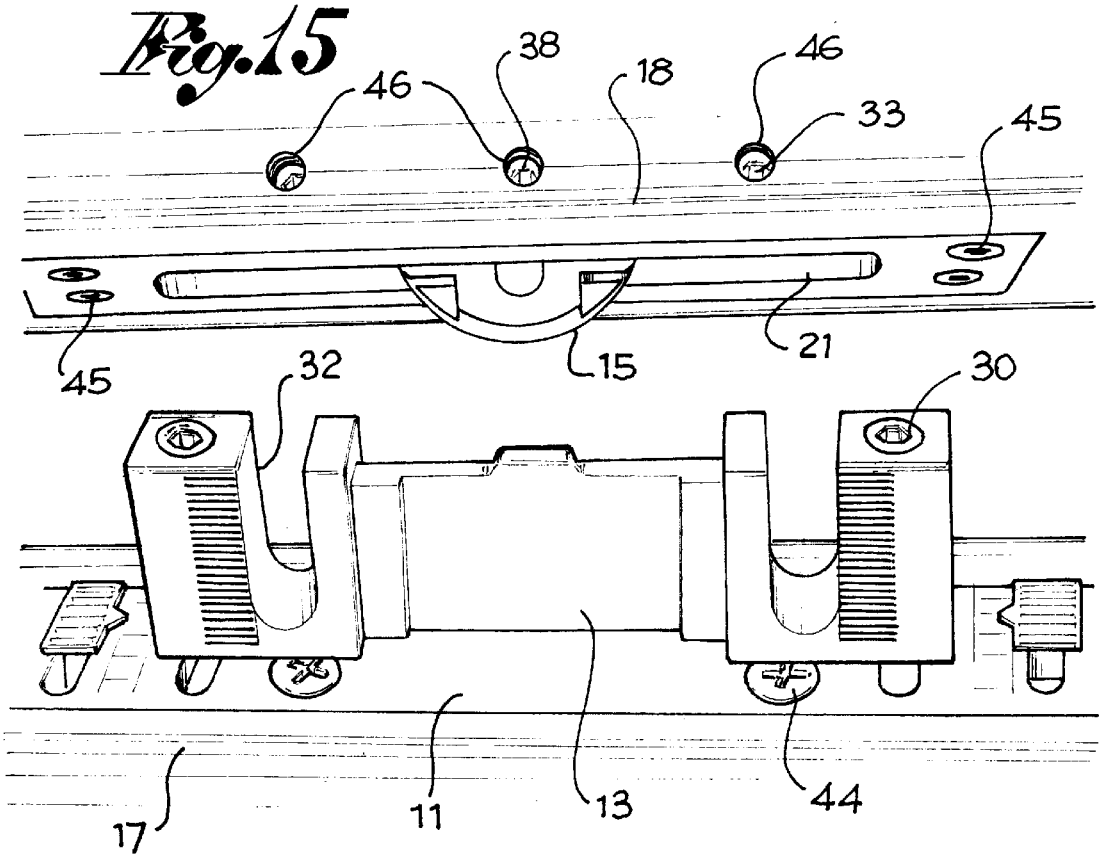

DEVICE FOR SETTING THE STOCK ANGLE FOR SHOTGUNS

FIELD OF THE INVENTION

This invention generally concerns the stocks of hunting and target practice shotguns and refers in more detail to a device for setting the angle of these stocks.

BACKGROUND OF THE INVENTION

While rifle stocks can be created in special, customized shapes they sometimes have a longitudinal top part called a plate, cheek pad or even toe which can be moved and positioned with respect to the remaining part of the stock. This is to be able to vary the so-called angle of the stock, by setting it according to need, so that the person using the rifle can find a correct and reliable position for his support cheek. Various devices for this variation/adjustment of the stock angle have already bin proposed. Examples among others are those described in U.S. Pat. Nos. 2,432,519, 3,710,496, 5,031,348, 5,235,764.

SUMMARY AND OBJECTS OF THE INVENTION

The purpose of this invention is to propose and create a device for setting the angle in a rifle stock, a new device of original execution and one capable of permitting the moving and positioning of the mobile part of the stock in several directions for maximum effective adaptation of the configuration of the stock to the most widely diverse requirements of the person using the rifle.

The purpose is reached in accordance with the invention, with a device and a stock composed of a main body and an element which can be moved, located longitudinally above an upper part of the main body. The device includes a fixed plate for fixing to the upper part of the main body and a mobile plate for fixing to a base of the mobile element of the stock facing the fixed plate. A vertical guide element is anchored perpendicularly above the fixed plate and positioned at least in a transverse direction to the fixed plate. The fixed plate defines two U shaped transverse recesses extending according to the height of the guide element and open towards the top. This vertical guide element passes freely into an opening made in the mobile plate. There are also elements to block the mobile plate to the vertical guide with transverse locking screws that move in the transverse U shaped recesses, and accessible through coinciding holes made in the movable element of the stock, so that the said mobile plate together with the movable element of the stock fixed to it can be moved and positioned in several directions and angularly on and with respect to the main body of the stock.

An advantage of the invention is that its components can be obtained from a pressed techno-polymer, thus reducing the engineering work and consequently the costs.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIGS. 10 and 11 show another two transverse sections according to arrows C—C and D—D, respectively on FIG. 5;

FIG. 12 shows another longitudinal section of the device according to arrows E—E on FIG. 6;

FIGS. 13 and 14 show the device in two different use positions;

FIG. 15 is a view of the two portions of the stock just prior to assembling the two portions; and FIG. 16 is a view of the present invention showing the two portions of the stock being assembled.

DETAILED DESCRIPTION OF THE PREFERRED EMBODIMENT

Figure 3:
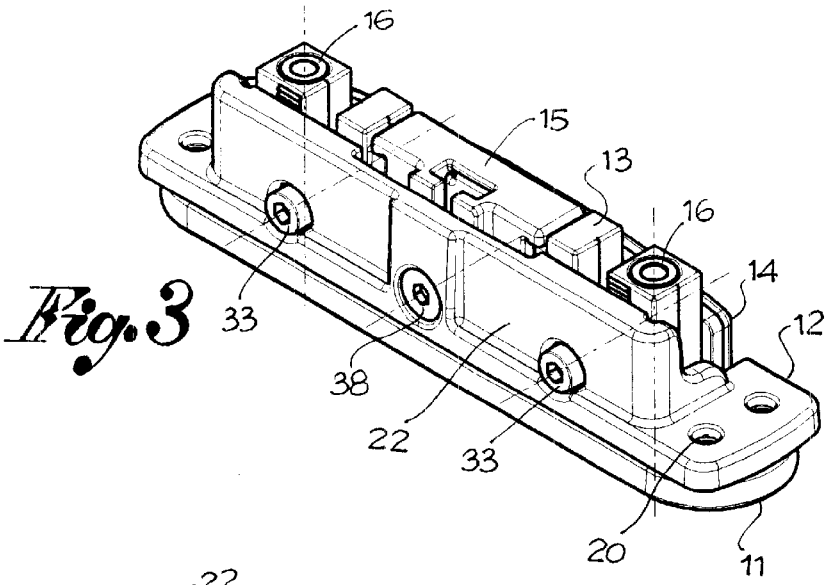
FIGS. 3 and 4 respectively show perspectives from above and below, of the assembled device.
Figure 1:
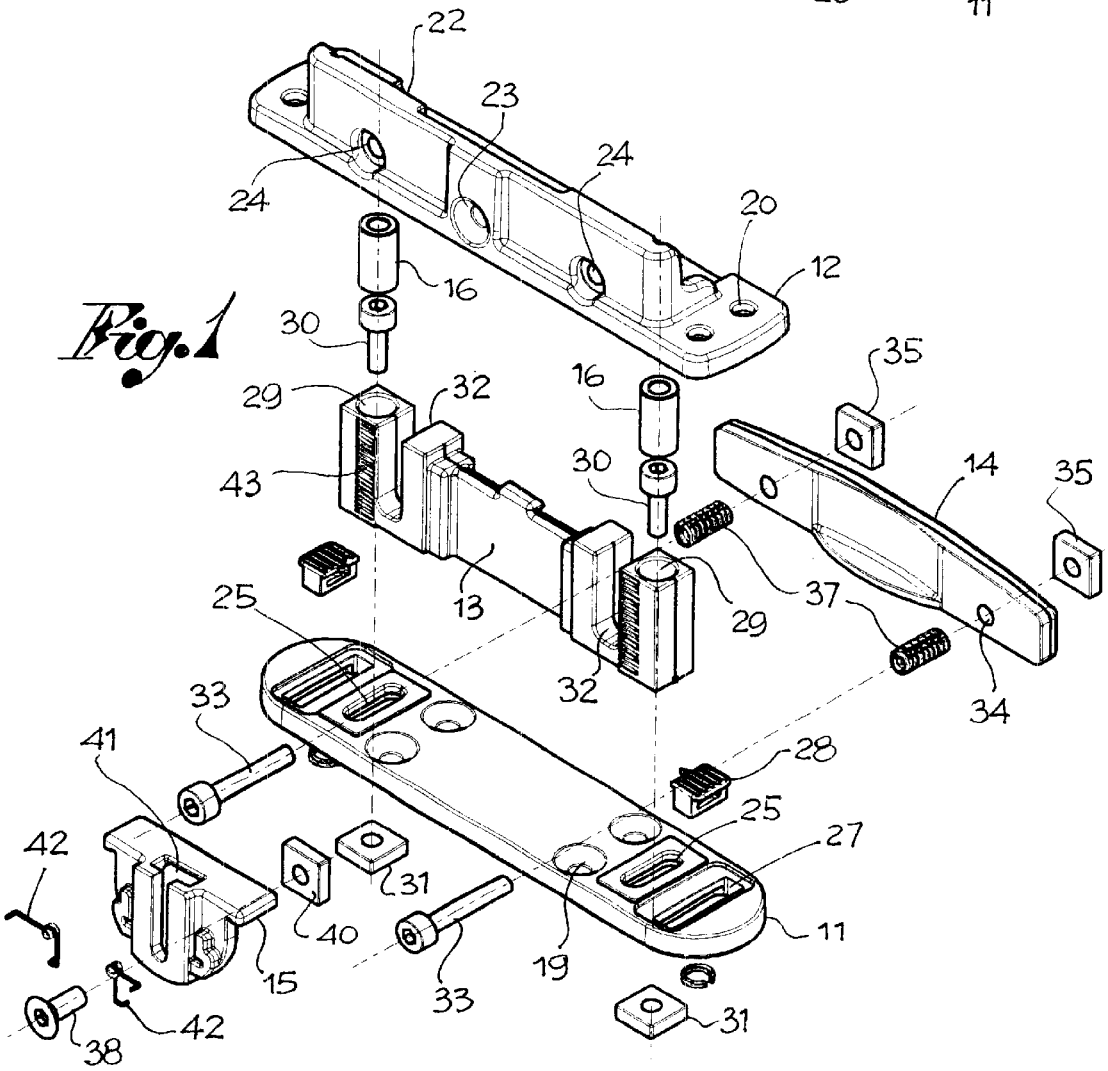
FIGS. 1 and 2 respectively show perspectives from above and below, of the exploded elements of the device.
Figure 4:
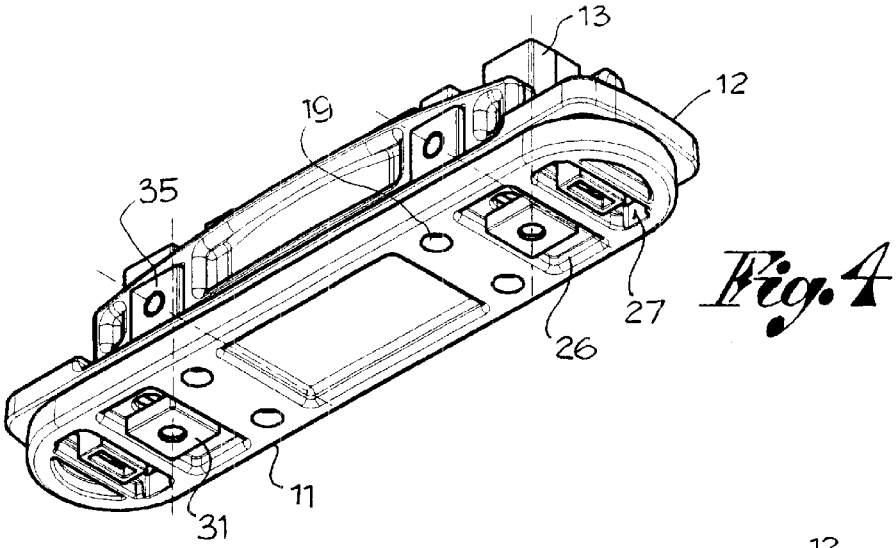
Figure 2:
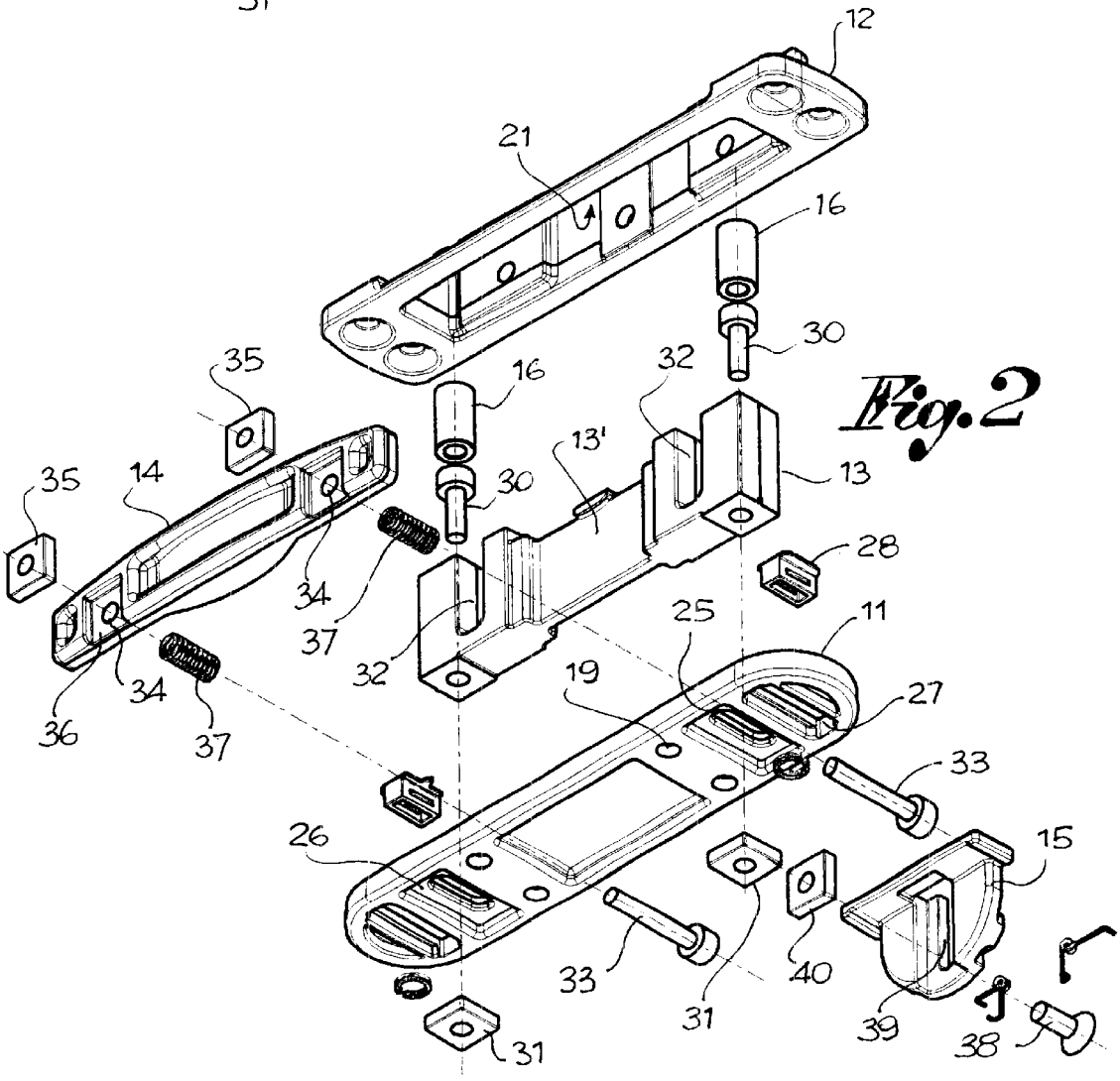
Figure 5:
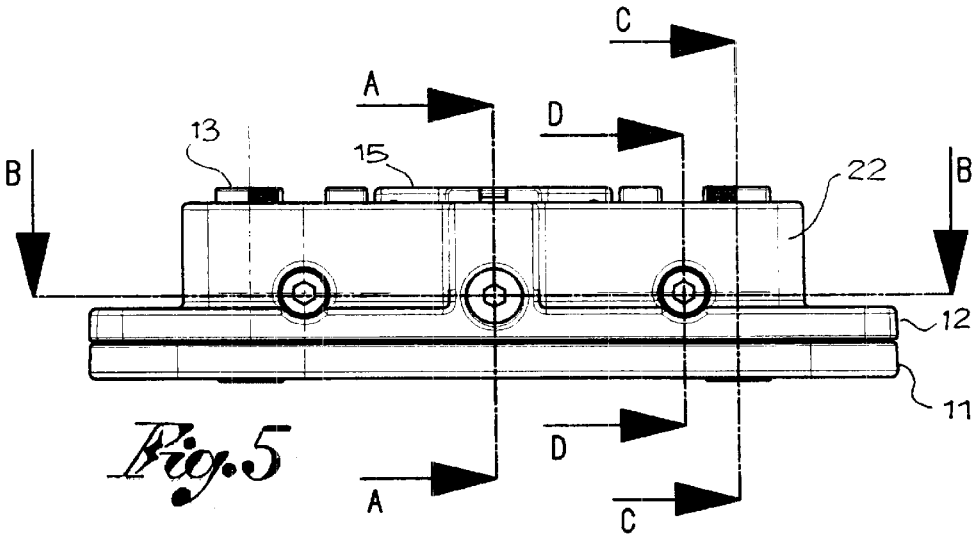
FIG. 5 shows a view of the front of the assembled device.
Figure 6:
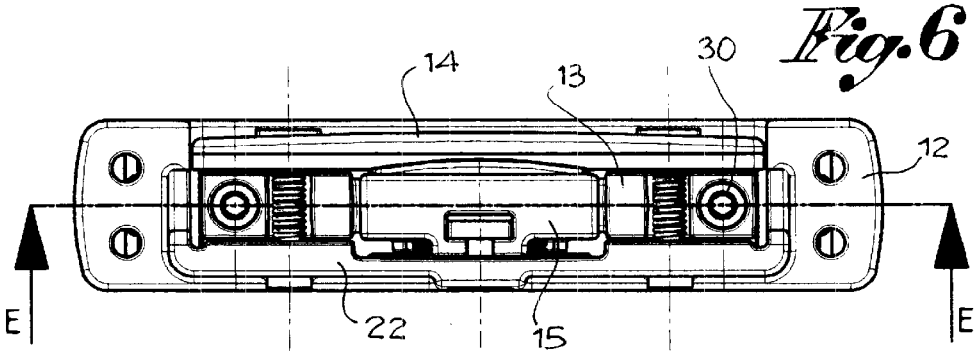
FIG. 6 shows a view of the device from above.
Figure 7:
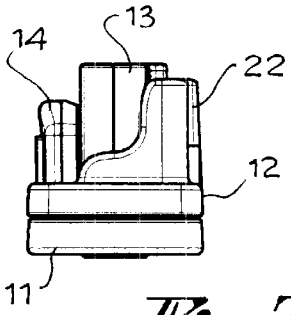
FIG. 7 shows a view from one end of the device.
Figure 8:
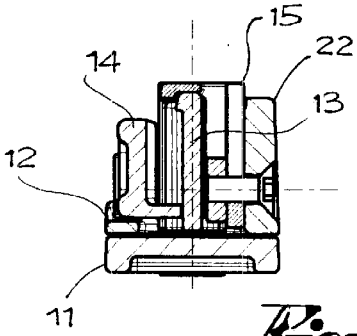
FIG. 8 shows a transverse section of the device according to arrows A—A on FIG. 5.
Figure 9:
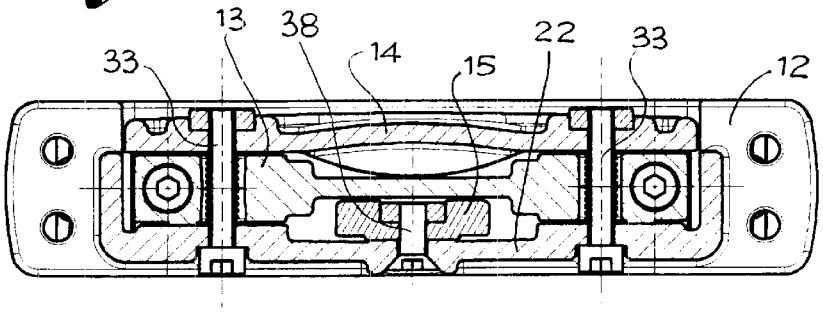
FIG. 9 shows a longitudinal section according to arrows B—B on FIG. 5.

According to the creation represented, the device essentially includes a fixed plate 11, a mobile plate 12, a vertical guide 13, a locking plate 14, a memory element 15 and two bushings 16.

The stock for shotguns to which the device is applied usually includes a main body 17 and a mobile, attached part 18, called a plate or cheek pad which serves to set the angle of the stock. The mobile part 18 is located longitudinally in the upper part of the stock with the possibility of movements and orientation in various directions.

The fixed plate 11 has holes 19 for the passage of the screws 44 to fix it longitudinally to the upper part of the main body 17 of the stock. The mobile plate 12 is fixed to the base of the mobile element 18 of the stock using screws 45 passing through holes 20 made in the plate itself.

The mobile plate 12 is located facing the fixed plate 11 corresponding to a hollow 18', formed in the mobile element 18 of the stock. The mobile plate 12 has a substantially rectangular opening 21 along its length. Along at least one of the longer sides of this opening 21 a square clamping rib 22 is created that rises up from the face of the mobile plate 12 opposed to the facing one of the fixed plate and therefore towards the bottom of hollow 18'. The following are transversely made in the square rib 22: a central hole 23 and two similar holes 24, —these latter ones on opposite sides to the central one. In a transverse direction, two slots 25, spaced in parallel are made in the fixed plate 11. On the face below the fixed plate 11, a rectangular recess 26 is made corresponding to each slot 25. Adjacent to each slot 25, a groove 27 may be made in the fixed plate 11 into which a sliding reference cap may be inserted.

The vertical guide element 13, is foxed to the plate 11 and passes freely into the opening 21 of the mobile plate 12, alongside the square rib 22 of this latter. For fixing, the vertical guide 13 has a pair of vertical holes 29 into which a vertical blocking screw 30 is inserted from above. The screw 30 passes through a corresponding slot 25 in the fixed plate 11 and screws into a square nut 31 which is retained without rotating but which can translate in the rectangular recess 26 bellow the fixed plate corresponding to the slot itself A bushing 16 may be inserted into each vertical hole 29, above the head of the blocking screw 30.

The vertical guide 13 also has two U shaped recesses 32, spaced apart from each other, open at the top and extending downwards according to the height of the guide itself The mobile plate 12 is fixed to the vertical guide 13 with the aid of the locking or clamping shoe 14, this tatter, being arranged to the side of the vertical guide 13 on the side opposite to the square rib 22. In other words, the vertical guide 13 is positioned between the square rib 22 of the mobile plate 12 and the locking shoe 14. This fixing is obtained through transverse screws 33 15 which are inserted into the corresponding holes 24 of the said square rib 22, which pass through the recesses 32 of the said vertical guide 13 and into coinciding holes 34 made in the tightening shoe 14 and which screw into square nuts 35 on the external face of the said shoe; the nuts 35 being retained to stop them rotating in recesses 36 made on the external face of 20 the shoe 14.

Preferably, a helical spring 37, is fitted around each transverse screw 33 which works between the square rib 22 and the tightening shoe 14, facilitating the release of the coupled parts when the said screws 33 are unscrewed. For their tightening unscrewing the screws 33 are accessible through holes made in the mobile part of the stock.

The vertical guide 13 has an intermediate, tapered part 13' and the memory element 15 is located between the square rib 22 of the mobile plate 12 and the vertical guide 13, in correspondence with the said tapered part 13'. More precisely, the memory element 15 is fixed to the rib 22 with a screw 38 that is housed in the central hole made in the rib itself that passes through a coinciding slot 39 made in the memory element and which screws into a square nut 40, retained to prevent rotation but to permit translation in a groove 41 made in the element itself. This element oscillates on the shank of the screw 38 contrasted in this movement by the opposing springs 42.

When this device is applied to the main body and to the mobile element of a rifle stock it is possible to modify the position according to need of the mobile element on the fixed body, both in height and transversely, and by keeping it parallel to itself or by modifying its angulations vertically and laterally above the main body as shown in FIGS. 13 and 14. This is obtained by acting on the vertical screws 30 and the horizontal ones 33 and thanks to the transverse slots 25 and the U shaped vertical recesses 32. The screws 33 and 38 are accessed through coinciding holes 46.

In any case, the mobile element of the stock can be then fixed in the desired position using the locking system, created as described above, with the assistance of the tightening shoe 14. The memory element 15 permits the setting and memorization of every determinate position that must be reset after any movements of the mobile element of the stock.

Finally it should be noted that the guide element 13 may bear the graduations 43 on at least one side to give a visual indication of the positions assumed by the mobile plate 12 and with this of the mobile element, above the main body of the stock.

What is claimed is:

1. A device for setting the angle in a firearm stock, where the stock is composed of a main body and a movable element which can be moved, located longitudinally above an upper part of the main body and where the device includes a fixed plate for fixing to the upper part of the main body and a mobile plate for fixing to a base of the movable element of the stock facing the fixed plate, characterized by a vertical guide element anchored perpendicularly above the fixed plate, that can be positioned at least in a transverse direction to said fixed plate, with two U shaped transverse recesses extending according to a height of said guide element and open towards a top of said guide element: said vertical guide element passes freely into an opening made in the mobile plate, there are also elements to block said mobile plate to said vertical guide with passing, transverse locking screws that move in said transverse U shaped recesses, accessible through coinciding holes made in the movable element of the stock, so that said mobile plate together with the movable element of the stock fixed to it can be moved and positioned in several directions and angularly on and with respect to the main body of the stock.

2. A device according to claim 1 in which a memory element, adjustable in height and oscillatable following movements of the mobile plate, is placed between the mobile plate and the vertical guide element.

3. A device according to claim 1, in which said vertical guide element is anchored to the fixed plate with a pair of vertical screws passing down from above that move in transverse slots made in said fixed plate: each of these said screws screw into respective non rotating nuts located and retained under the fixed plate.

4. A device according to claim 1, in which along at least one side of the opening in the mobile plate, a square rib rises up running adjacently to one side of the vertical guide element, in which along another side of the vertical guide element a mobile locking shoe is provided which can be separated from the mobile plate and in which said transverse locking screws connect said square rib to said locking shoe by passing through said U shaped recesses to block the mobile plate to the vertical guide element in each of the positions assumed by the mobile plate together with the element that can be moved of the stock.

5. A device according to claim 4 in which at least one spring is placed between said square rib and said locking shoe to slacken said shoe when the transverse screws are unscrewed.

6. A device according to claim 1, in which graduated scales are marked on parts of the fixed plate and/or the vertical guide element to display the different positions that the mobile plate can assume with respect to the fixed ones.

7. A device according to claim 2, in which said vertical guide element is anchored to the fixed plate with a pair of vertical screws passing down from above that move in transverse slots made in said fixed plate: each of these said screws into respective non rotating buts located and retained under the fixed plate.

8. A device according to claim 2, in which along at least one side of the opening in the mobile plate, a square rib rises up running adjacently to one side of the vertical guide element, in which along another side of the vertical guide element a mobile locking shoe is provided which can be separated from the mobile plate and in which said transverse locking screws connect said square rib to said locking shoe by passing through said U shaped recesses to block the mobile plate to the vertical guide element in each of the positions assumed by the mobile plate together with the element that can be moved of the stock.

9. A device according to claim 3, in which along at least one side of the opening in the mobile plate, a square rib rises up running adjacently to one side of the vertical guide element, in which along another side of the vertical guide element a mobile locking shoe is provided which can be separated from the mobile plate and in which said transverse locking screws connect said square rib to said locking shoe by passing through said U shaped recesses to block the mobile plate to the vertical guide element in each of the positions assumed by the mobile plate together with the element that can be moved of the stock.

10. A device according to claim 2, in which graduated scales are marked on parts of the fixed plate and/or the vertical guide element to display the different positions that the mobile plate can assume with respect to the fixed ones.

11. A device according to claim 3, in which graduated scales are marked on parts of the fixed plate and/or the vertical guide element to display the different positions that the mobile plate can assume with respect to the fixed ones.

12. A device according to claim 4, in which graduated scales are marked on parts of the fixed plate and/or the vertical guide element to display the different positions that the mobile plate can assume with respect to the fixed ones.

13. A device according to claim 5, in which graduated scales are marked on parts of the fixed plate and/or the vertical guide element to display the different positions that the mobile plate can assume with respect to the fixed ones.

14. A device for setting an angle of a movable element on a stock of a firearm, the device comprising:

a fixed plate fixable to the stock;

a guide element movably connected to said fixed plate, said guide element defining two U shaped recesses with a longitudinal axis;

a mobile plate connected to the movable element on the stock and defining an opening receivable of said guide element;

a first clamping element fixed to said mobile plate;

a second clamping element movably connected to first clamping element by fasteners to clamp said guide element to said fixed plate, said fasteners passing through said U-shaped recesses and being movable in said U-shaped recesses along said longitudinal axis, said guide element being movably connected to said fixed plate and said U-shaped recesses being arranged to cause said mobile plate to be positionable in a plurality of several different angular and lateral positions with respect to said fixed plate.

15. A device in accordance with claim 14, wherein:

said guide plate extends substantially perpendicular to said fixed plate;

said longitudinal axis of said two U-shaped recesses extend substantially perpendicular to said fixed plate;

said two U-shaped recesses are open away from said fixed plate.

* * * * *

UNITED STATES PATENT AND TRADEMARK OFFICE

CERTIFICATE OF CORRECTION

PATENT NO. : 6,457,273 B2
APPLICATION NO. : 09/739522
DATED : October 1, 2002
INVENTOR(S) : Gussalli Beretta It is certified that error appears in the above-identified patent and that said Letters Patent is hereby corrected as shown below:

On title page (item 30)

Please correct the Assignees' priority number to read follows:

BS 2000 A 000010

Signed and Sealed this

Third Day of October, 2006

JON W. DUDAS
*Director of the United States Patent and Trademark Office*